United States Patent [19]

Léger

[11] 4,346,825

[45] Aug. 31, 1982

[54] HAT SUPPORTING DEVICE

[76] Inventor: Jean-Paul Léger, 4776 Du Tremblay, Chomedey, Laval, Quebec H7W 2S9, Canada

[21] Appl. No.: 84,899

[22] Filed: Oct. 15, 1979

[30] Foreign Application Priority Data

Feb. 23, 1979 [CA] Canada ..... 322236

[51] Int. Cl.[3] ..... A47F 7/19; A47J 51/086; A47J 51/097

[52] U.S. Cl. ..... 223/66; 223/87; 223/88; 211/113; 211/119

[58] Field of Search ..... 223/85, 87, 88, 97, 223/66, 84; 211/30, 31, 32, 113, 119; 248/339, 340; 24/343; 206/8, 9, 288, 293, 295; D6/247, 253, 255, 256, 248, 251

[56] References Cited

U.S. PATENT DOCUMENTS

| | | | |
|---|---|---|---|
| 878,814 | 2/1908 | Maloney | 211/32 UX |
| 1,281,562 | 10/1918 | Hanson | 223/88 |
| 1,824,710 | 9/1931 | De Carlo | 211/31 |
| 2,494,487 | 1/1950 | Pfeil | 211/32 |
| 2,630,921 | 3/1953 | Stephenson et al. | 211/32 |
| 2,777,582 | 1/1957 | Van Dusen | 211/119 |
| 2,994,436 | 8/1961 | Stull et al. | 211/30 |
| 3,310,272 | 3/1967 | Brunger | 211/113 |
| 3,692,269 | 9/1972 | Hales | 248/339 X |
| 4,136,784 | 1/1979 | Knobel et al. | 211/119 |

FOREIGN PATENT DOCUMENTS

| | | | |
|---|---|---|---|
| 1121461 | 4/1956 | France | 211/119 |
| 1364984 | 5/1964 | France | 211/119 |
| 375917 | 10/1939 | Italy | 211/31 |
| 2043440 | 10/1980 | United Kingdom | 223/97 |

*Primary Examiner*—Robert Mackey
*Attorney, Agent, or Firm*—Larson and Taylor

[57] ABSTRACT

A portable hat supporting device is disclosed for displaying soft wool hats and providing a support for a soft hat which does not distort the hat. The device is suitable for home use and for display in stores. The device comprises a frame having at least one suspension means adapted to support the frame, the frame including at least one member extending downwards from the suspension means terminating at a horizontal cross bar, hat support means extending up from the cross bar, the hat support means having a curved profile and adapted to support a soft hat below the suspension member.

13 Claims, 9 Drawing Figures

HAT SUPPORTING DEVICE

The present invention relates to a hat supporting device or more specifically a device that supports and displays soft hats such as woolen hats without deforming the hats, and in some cases supports mitts and scarves.

In clothing stores and department stores, soft woolen hats and other types of soft hats, mitts and scarves are generally displayed on table tops or counter tops. In some cases, they are placed in sliding drawers, thus can only be partially seen by the public when walking around a store. In stores where coats are sold, there are invariably no places for displaying hats, scarves and mitts, and thus there is a need for a display device to display these items where coats are sold. The present invention provides a novel display device wherein soft woolen hats or other soft hats may be displayed on a special hanging apparatus in the same area where coats are displayed.

The display apparatus allows the hat and, in other embodiments, mitts and scarf to be displayed adjacent the coats so that members of the public can see a hat alongside a coat to make sure they match. Thus a shopper is able to make a choice of hat to match a coat more easily than when a hat is separately displayed on a counter top.

Soft woolen hats are generally hung on pegs or hooks and this tends to distort them. The present invention provides a portable apparatus for supporting a soft hat which does not distort the hat. The apparatus finds use in a store and in the home where hats may be hung in closets or on coat racks. A soft hat may be suspended from a hat supporting apparatus which provides a non damaging support. The apparatus may also support mitts and a scarf thus keeping a set of hat, mitts and scarf together.

The present invention provides an apparatus for supporting a soft hat comprising a frame having at least one suspension means adapted to support the frame, the frame including at least one member extending downwards from the suspension means terminating at a horizontal cross bar, hat support means extending up from the cross bar, the hat support means having a curved profile and adapted to support a soft hat below the suspension member.

In other embodiments, there is a suspension means at a top vertex of the frame, the suspension means may be a hook for hanging over a hanging bar.

In yet another embodiment, the apparatus has an additional support bar directly beneath the cross bar which is adapted to support a scarf. There may also be one or more additional profile support arms for supporting mitts.

In the drawings which illustrate embodiments of the invention,

Figure 7:
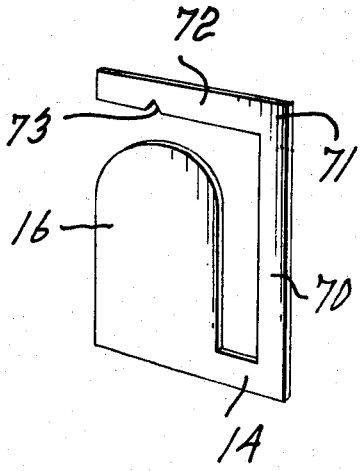

FIG. 7 on the first page of drawings is an isometric view of another embodiment of the present invention.

Figure 1:
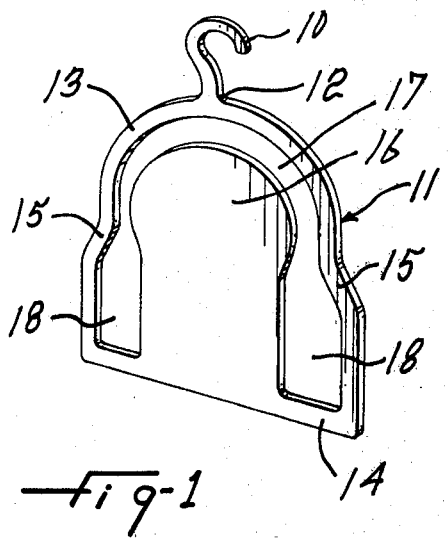
FIG. 1 is an isometric view of one embodiment of a supporting apparatus of the present invention.

Referring now to the drawings, all the devices shown herein may be made from rigid plastic, cardboard, plywood or sheet metal, or alternatively the devices may be formed from rigid wire and have substantially the same shape as the devices illustrated herein. In FIG. 1, a hook 10 supports a frame 11 from a hanger bar (not shown). The hook 10 is connected to a vertex 12 of an arch member 13 extending downwards on each side and joining at each end to a cross bar 14 extending across the base of the arch member 13. In the lower portion of the arch member 13, sloped shoulders 15 are supplied to extend the width of the arch member 13 at the base. The thickness of this arch member 13 is substantially the same throughout the length.

In the center of the cross bar 14, and attached thereto, is a hat support member 16 which extends up from the cross bar 14 within the arch member 13. The top portion of the hat support member 16 is curved so that it fits within the arch member 13 and retains a gap 17 having approximately the same spacing around the arch member 13 from one sloped shoulder 15 to the other sloped shoulder 15. The sides of the hat support member 16 are cut away opposite and below the sloped shoulders 15 down to the cross bar 14 so that a larger clearance 18 is provided between the side of the hat support member 16 and the lower portion of the arch member 13 than the gap 17. Thus, a soft woolen hat or other soft hat may be placed over the hat support member 16 and the hat is not distorted or deformed as it would be when it is hung from a peg or hook.

Figure 2:
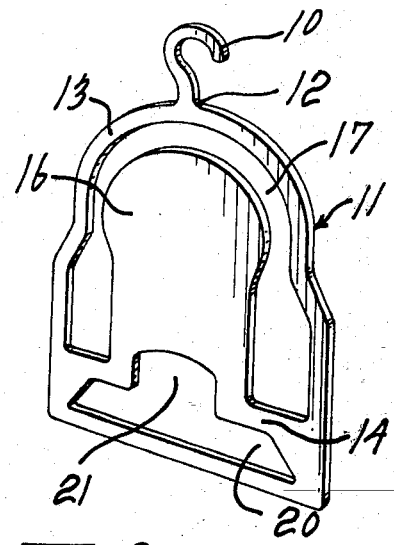
FIG. 2 is an isometric view of another embodiment of a supporting apparatus.

FIG. 2 shows another embodiment of the hat supporting device shown in FIG. 1 wherein a slot 20 is provided beneath the cross bar 14 to support a scarf. The slot 20 has an upper cut-out portion 21 for more easily threading the scarf through the slot 20.

Figure 3:
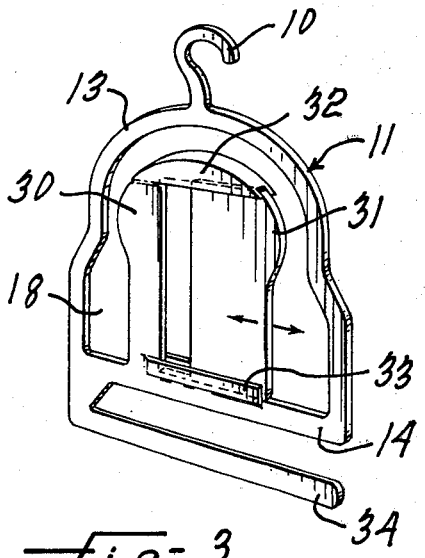
FIG. 3 is an isometric view of a further embodiment of a supporting apparatus having an adjustable profile for the hat support means.

FIG. 3 shows yet another embodiment of the hat supporting device wherein the hat supporting member is adjustable. The hat supporting member has a fixed portion 30 at one side thereof and a sliding portion 31 sliding in a top support 32 and bottom support 33. Thus, the size of the hat support member may be varied by sliding the sliding portion 31 backwards and forwards to accommodate different sizes of hat. Furthermore, in the apparatus shown in FIG. 3, an open ended support bar 34 is provided beneath the cross bar 14, which may be used for supporting a scarf or the like.

Figure 4A:
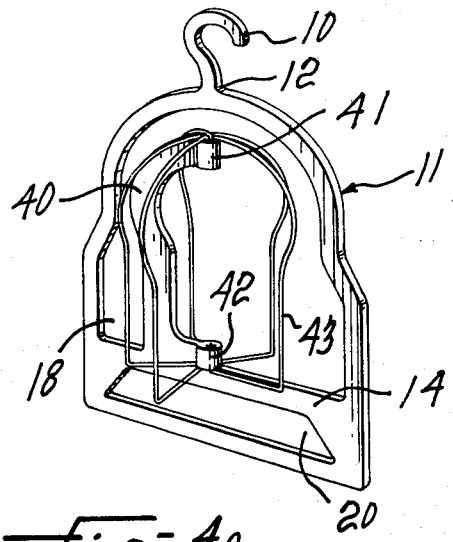
FIG. 4A is an isometric view of yet another embodiment of the supporting apparatus according to the present invention.
Figure 4B:
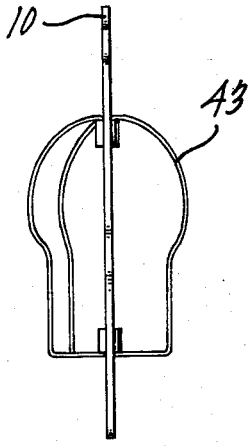
FIG. 4B is an end view of the supporting apparatus shown in FIG. 4A.

In the device shown in FIGS. 4A and 4B, the hat support member has a fixed portion 40 with a top pivot point 41 and a bottom pivot point 42 in line directly beneath the vertex 12 of the frame 11. A number of wire frames 43 are pivoted in the top pivot position 41 and the bottom pivot position 42. These wire frames 43 all have the profile of the hat support member 16 but are able to pivot around so that they form a three dimensional shape rather than a flat two dimensional shape to better support and display a hat. The wire frames 43 may be folded flat when the device is not in use for easy storage.

Figure 5:
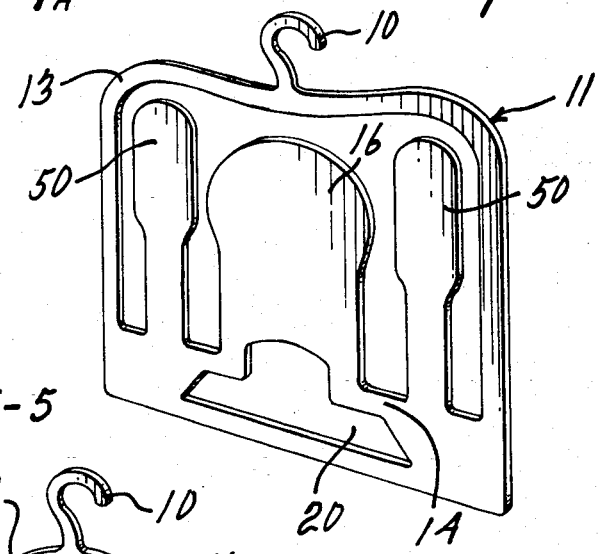
FIG. 5 is an isometric view of a still further embodiment of a supporting apparatus having support means for a hat, mitts and a scarf.

FIG. 5 illustrates another hat supporting device having a hat support member 16 in the center thereof. However, in the frame 11, the arch member 13 extends considerably further out than the previously illustrated hat supporting devices to encompass two additional profile support arms 50 which are shaped to support mitts. These mitt support arms 50 are wider in their top portion than in their bottom portion and extend upwards from the cross bar 14. Also shown in the hat supporting device is a slot 20 for supporting a scarf similar to that shown in FIG. 2.

Figure 6A:
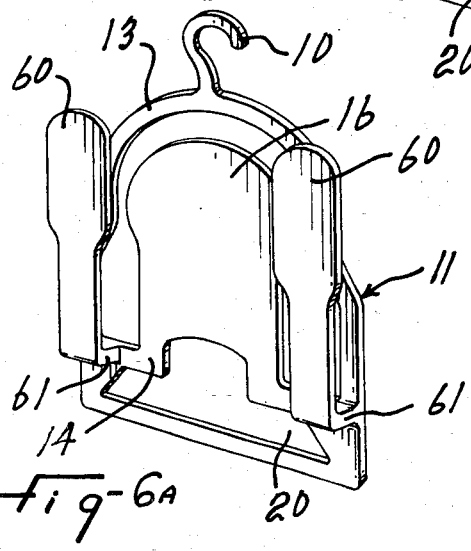
FIG. 6A is an isometric view of another embodiment of a supporting apparatus having support means for a hat, mitts and a scarf.
Figure 6B:
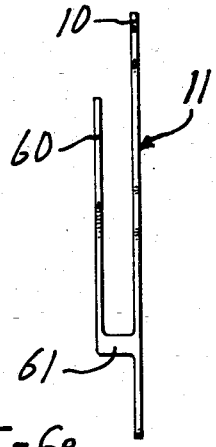
FIG. 6B is an end view of the supporting apparatus shown in FIG. 6A.

FIGS. 6A and 6B illustrate another embodiment of a hat supporting device also having profile support arms 60 for mitts. In this case, the support arms 60 are located in a separate plane to the main frame 11 supported on two lateral extensions 61 extending out from the cross bar 14 on either side of the hat support member 16. A slot 20 for scarf is also provided.

FIG. 7 illustrates a different embodiment of the invention, still having the hat support member 16 supported underneath by the cross bar 14. However, the cross bar is connected at one side to a vertical suspension arm 70 which has an elbow 71 connecting to a horizontal member 72 extending across the top of the hat support member 16 and spaced therefrom. A suspension means in the form of a notch 73 is provided above the approximate center of the hat support member 16 positioned so the unit hangs substantially straight from the notch.

It will be apparent to those skilled in the art that various changes may be made to the hat supporting device of the present invention without departing from the scope of the present invention which is only limited by the claims.

The embodiments of the invention in which an exclusive property or privilege is claimed are defined as follows:

1. An apparatus for supporting a knitted soft hat and a scarf comprising a frame having at least one suspension means adapted to support the frame, the frame including a pair of outer laterally disposed frame members extending downwards from the suspension means, hat support means for supporting a knitted soft hat, the hat support means comprising a hat support member having a profile generally following the inner shape of a knitted soft hat and adapted to support a knitted soft hat below the suspension means, the hat support member including a pair of generally straight lateral edge portions joined by a central at least partially curved edge portion such that said edge portions form said profile, the lateral and central edge portions being spaced from the inner edges of said frame members an amount sufficient to permit a said soft knitted hat to be readily placed on said hat support member, and a scarf support means, located below hat support member, for supporting a scarf and including a horizontal bar portion which defines the lower edge of an opening of sufficient size to receive a scarf therein so that, in use, the said scarf is inserted into said opening and extends over said bar portion to be supported thereby, said scarf support means and said hat support means lying in the same plane and said apparatus including no moving parts.

2. The apparatus according to claim 1 wherein the suspension means includes a hook adapted to fit over a hanger bar.

3. The apparatus according to claim 1 including two additional profiled support arms, one on each side of the hat support means adapted to support a pair of mitts.

4. The apparatus according to claim 1 including two additional profile support arms on a separate plane spaced apart on each side of the hat support means adapted to support a pair of mitts.

5. The apparatus according to claim 1 wherein the frame is formed of rigid plastic.

6. The apparatus according to claim 1 wherein the frame is formed of cardboard.

7. The apparatus according to claim 1 wherein the frame is formed of plywood.

8. The apparatus according to claim 1 wherein the frame is formed of sheet metal.

9. An apparatus as claimed in claim 1 wherein said frame further comprises a crossbar, located above said horizontal bar portion, which defines an upper edge of said scarf receiving opening.

10. An apparatus as claimed in claim 1 or claim 9 wherein said scarf supporting means further comprises downwardly depending portions of said frame which define lateral edges of said scarf receiving opening.

11. An apparatus as claimed in claim 10 wherein said pair of laterally disposed frame members form, taken together, an arch of the general shape of an inverted U.

12. An apparatus as claimed in claim 1 wherein the space between the inner edges of said frame members and the said edge portions of said hat support means is of the general shape of an inverted U and wherein at least a majority of the area of said scarf receiving opening lies below the lower extremities of said space.

13. An apparatus as claimed in claim 12 wherein said frame and said suspension means are formed of plastic and are of an integral one piece construction.

* * * * *